US009230759B2

(12) United States Patent
Horinouchi et al.

(10) Patent No.: US 9,230,759 B2
(45) Date of Patent: Jan. 5, 2016

(54) GAS CIRCUIT BREAKER

(71) Applicants: Katsuhiko Horinouchi, Chiyoda-ku (JP); Motohiro Sato, Chiyoda-ku (JP); Kazuki Kubo, Chiyoda-ku (JP); Yuhei Awano, Chiyoda-ku (JP)

(72) Inventors: Katsuhiko Horinouchi, Chiyoda-ku (JP); Motohiro Sato, Chiyoda-ku (JP); Kazuki Kubo, Chiyoda-ku (JP); Yuhei Awano, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 43 days.

(21) Appl. No.: 14/363,922

(22) PCT Filed: Oct. 11, 2012

(86) PCT No.: PCT/JP2012/076311

§ 371 (c)(1),
(2) Date: Jun. 9, 2014

(87) PCT Pub. No.: WO2013/118348

PCT Pub. Date: Aug. 15, 2013

(65) Prior Publication Data

US 2014/0367361 A1 Dec. 18, 2014

(30) Foreign Application Priority Data

Feb. 6, 2012 (JP) ..... 2012-022678

(51) Int. Cl.
*H01H 33/22* (2006.01)
*H01H 33/06* (2006.01)
(Continued)

(52) U.S. Cl.
CPC ..... *H01H 33/06* (2013.01); *H01H 33/74* (2013.01); *H01H 33/78* (2013.01); *H01H 33/88* (2013.01); *H01H 33/91* (2013.01); *H01H 2033/906* (2013.01)

(58) Field of Classification Search
CPC ..... H01H 33/22; H01H 2033/566; H01H 33/765; H01H 33/91
See application file for complete search history.

(56) References Cited

U.S. PATENT DOCUMENTS 4,562,322 A 12/1985 Yamaguchi et al.
4,904,977 A * 2/1990 Mahieu ..... H01H 33/7023 337/203

(Continued)

FOREIGN PATENT DOCUMENTS

CN 1898761 A 1/2007
JP 57-202003 12/1982

(Continued)

OTHER PUBLICATIONS

International Search Report issued Jan. 8, 2013, in PCT/JP2012/076311, filed Oct. 11, 2012.

(Continued)

*Primary Examiner* — Truc Nguyen
(74) *Attorney, Agent, or Firm* — Oblon, McClelland, Maier & Neustadt, L.L.P.

(57) ABSTRACT

A gas circuit breaker includes: a pair of electrodes provided so as to be able to come in contact with and separate from each other; and an insulating material that is placed so as to generate a decomposition gas in response to a direct or indirect action from an arc occurring between the pair of electrodes when a current is broken, wherein the decomposition gas generated from the insulating material when the current is broken is configured to be utilized for extinguishing the arc, and wherein an ablative material that does not include hydrogen atoms but has a carbon-oxygen bond in a main chain or ring part is used as the insulating material.

8 Claims, 4 Drawing Sheets

(51) Int. Cl.

| | |
|---|---|
| ***H01H 33/78*** | (2006.01) |
| ***H01H 33/91*** | (2006.01) |
| ***H01H 33/74*** | (2006.01) |
| ***H01H 33/88*** | (2006.01) |
| *H01H 33/90* | (2006.01) |

(56) References Cited

U.S. PATENT DOCUMENTS

| | | | | |
|---|---|---|---|---|
| 5,231,256 | A * | 7/1993 | Yamagiwa | H01H 33/7069 218/63 |
| 5,687,472 | A * | 11/1997 | Honma | H01H 33/66 218/136 |
| 5,990,440 | A * | 11/1999 | Yamaguchi | H01H 9/302 218/158 |
| 6,163,001 | A | 12/2000 | Zehnder et al. | |
| 6,664,494 | B2 * | 12/2003 | Kida | H01H 1/385 218/43 |
| 7,754,991 | B2 * | 7/2010 | Bessede | H01H 33/22 218/158 |
| 8,822,870 | B2 * | 9/2014 | Mantilla | H01B 3/56 218/118 |
| 2008/0217297 | A1 * | 9/2008 | Kanazawa | H01H 1/0015 218/63 |
| 2013/0161289 | A1 | 6/2013 | Horinouchi et al. | |
| 2015/0228427 | A1 * | 8/2015 | Kim | H01H 33/121 218/11 |

FOREIGN PATENT DOCUMENTS

| | | | |
|---|---|---|---|
| JP | 1-45690 | | 10/1989 |
| JP | 7-161250 | A | 6/1995 |
| JP | 11-329191 | | 11/1999 |
| JP | 2003-224907 | | 8/2003 |
| JP | 2003-297200 | | 10/2003 |
| JP | 2004-39440 | A | 2/2004 |
| JP | 2005-332745 | A | 12/2005 |
| JP | 2009-65097 | A | 3/2009 |

OTHER PUBLICATIONS

Office Action issued Dec. 2, 2014 in Japanese Patent Application No. 2013-557362 (with partial English language translation).

Office Action issued Aug. 21, 2015 in Chinese Patent Application No. 201280067061.9 (with English translation).

* cited by examiner

GAS CIRCUIT BREAKER

TECHNICAL FIELD

The present invention relates to a gas circuit breaker that blows an arc-extinguishing gas onto an arc occurring between the electrodes in breaking, for example, a large current due to a short circuit accident or a conduction current in a normal operation.

BACKGROUND ART

According to PTL 1, one conventional gas circuit breaker operates such that, with a high pressure generated in a heating chamber, when a next current zero point is to be crossed, an insulating gas in the heating chamber flows from a blowing slit through an arc chamber and a pressure chamber into an air outlet provided on the side opposite to the arc chamber in the pressure chamber, while the gas flows through the arc chamber into another air outlet chamber on an opening/closing pin side. In this example, the gas flow naturally crosses an arc, adequately removing its ionized gas in the cross range to prevent an arc from occurring after the crossing of the current zero point, which completes arc extinguishing.

According to PTL 2, an attached member that is heated by a gas heated by an arc to generate an evaporation gas is placed within a heating chamber to enhance pressure increase within the heating chamber. In this example, the attached member comprises a polymer having a chemical composition not including oxygen.

According to PTL 3, in an $SF_6$ gas insulating electric apparatus including an $SF_6$ gas insulator and a resin insulator coexisting in an atmosphere exposed to an arc, at least the surface part of a part exposed to the arc of the resin insulator comprises a fluorine resin including at least one type of high heat conductivity inorganic powder selected from boron nitride and beryllia and pigment particles having an average particle diameter of 1 μm or less.

CITATION LIST

Patent Literature

PTL 1: JP-A-11-329191
PTL 2: JP-A-2003-297200
PTL 3: JP-B-1-45690

SUMMARY OF INVENTION

Technical Problem

The circuit breaker according to PTL 1 has a problem as follows. A heated gas including hydrogen ions generated from its structural members, including the blowing slit, decomposing and evaporating due to the heat of the arc and fluorine ions generated from the insulating gas, including fluorine, decomposed by the arc flows out of the arc chamber into the another air outlet chamber. When the temperature of the heated gas decreases, the hydrogen ions bond with the fluorine ions into hydrogen fluoride. Hydrogen fluoride is highly corrosive to an insulator and is adsorbed onto an insulator supporting a structure to which a high voltage is applied, causing its insulation deterioration.

When the insulating gas includes oxygen, the circuit breaker has another problem as follows. A heated gas including hydrogen ions generated from its structural members, including the blowing slit, decomposing and evaporating due to the heat of the arc and oxygen ions generated from the insulating gas decomposed by the arc flows out of the arc chamber into the another air outlet chamber. When the temperature of the heated gas decreases, the hydrogen ions bond with the oxygen ions into water. Water reduces the insulating capability of an insulating gas and also is adsorbed onto an insulator supporting a structure to which a high voltage is applied, causing its insulation deterioration.

Furthermore, the gas circuit breaker according to PTL 2 uses the polymer having a chemical composition not including oxygen as the attached member that is heated by the gas heated by an arc to generate an evaporation gas within the heating chamber, so that the since decomposition of the polymer by the arc is not efficient. Therefore it is difficult to adequately increase the pressure within the pressure chamber. Furthermore, the gas circuit breaker according to PTL 3 uses PFA (tetrafluoroethylene-perfluoroalkylvinyl ether copolymer) that does not include hydrogen atoms and does have a carbon-oxygen bond only in a side chain as the fluorine resin used for the part exposed to an arc, but, since the decomposition of the polymer having a carbon-oxygen bond only in a side chain by the arc is not efficient, it is difficult to adequately increase the pressure within the pressure chamber.

In view of the above problems, it is an object of the present invention to provide a gas circuit breaker that can suppress insulation deterioration caused by a product resulting from an arc when the contact is opened and has a superior circuit breaking capability.

Solution to Problem

A gas circuit breaker of the invention includes: a pair of electrodes provided so as to be able to come in contact with and separate from each other; and an insulating material that is placed so as to generate a decomposition gas in response to a direct or indirect action from an arc occurring between the pair of electrodes when a current is broken, wherein the decomposition gas generated from the insulating material when the current is broken is configured to be utilized for extinguishing the arc, and wherein an ablative material that does not include hydrogen atoms but has a carbon-oxygen bond in a main chain or ring part is used as the insulating material.

Advantageous Effects of Invention

According to the gas circuit breaker of the invention, since the ablative material that does not include hydrogen atoms but has a carbon-oxygen bond in a main chain or ring part is used as the insulating material that generates a decomposition gas in response to the action from the arc, the heat of the arc breaks the carbon-oxygen bond in the main chain or ring part to be efficiently decomposed and gasified, which can adequately increase the pressure within the pressure chamber. Furthermore, generation of a compound, such as hydrogen fluoride and water, that may cause insulation deterioration can be suppressed. Thus, a gas circuit breaker having a superior circuit breaking capability with deterioration of insulating members installed suppressed can be obtained.

Other objects, features, aspects and effects of the present invention than described above will become more apparent from the following detailed description of the present invention when taken in conjunction with the accompanying drawings.

DESCRIPTION OF EMBODIMENTS

First Embodiment

Figure 1:
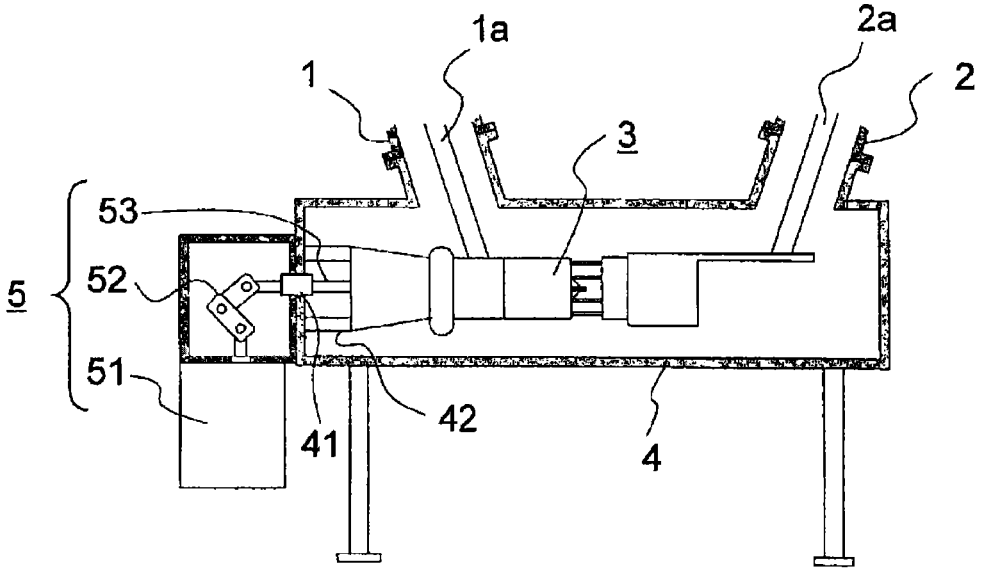
FIG. 1 is a cross-sectional view schematically showing a gas circuit breaker in accordance with a first embodiment of the invention.
Figure 2:
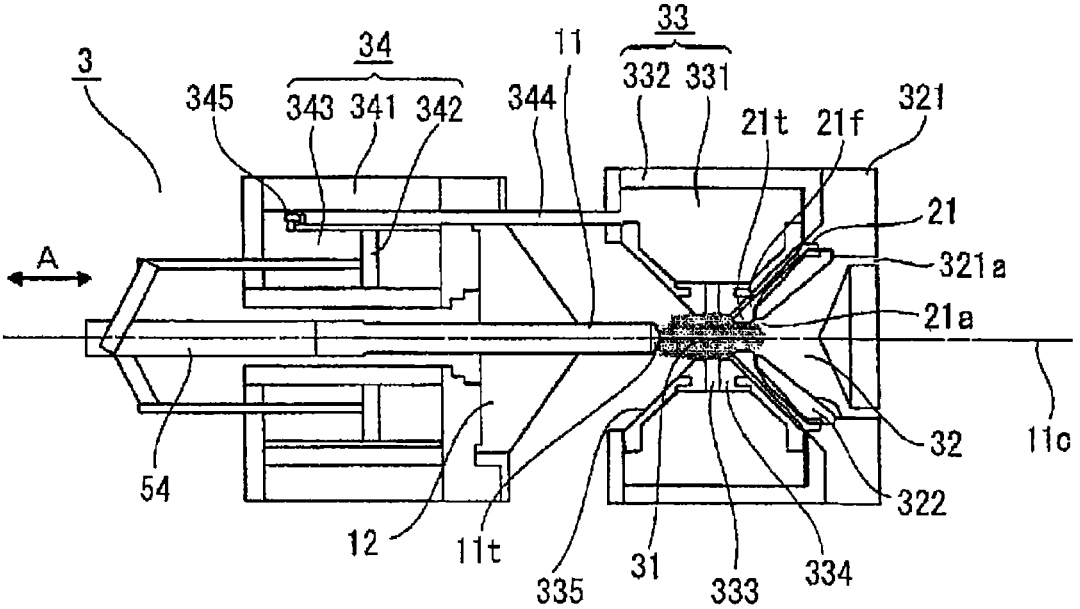
FIG. 2 is a cross-sectional view conceptually showing a main part of an arc extinguisher of the gas circuit breaker in accordance with the first embodiment of the invention.

FIG. 1 is a cross-sectional view schematically showing a gas circuit breaker in accordance with a first embodiment of the invention. FIG. 2 is a cross-sectional view conceptually showing a main part of an arc extinguisher of the gas circuit breaker shown in FIG. 1. Note that FIG. 2 shows a situation in which an arc is occurring between the tip portion of a movable electrode and the tip portion of a fixed electrode that are separated from each other in the course of a circuit breaking operation.

In FIGS. 1 and 2, the gas circuit breaker includes: a first conductor 1*a* extending from a first bushing 1; a second conductor 2*a* extending from a second bushing 2; a movable electrode 11 connected to the first conductor 1*a*; a fixed electrode 21 connected to the second conductor 2*a*; and an arc extinguisher 3 for extinguishing an arc occurring between the movable electrode 11 and the fixed electrode 21 when current is broken. The first conductor 1*a*, the second conductor 2*a*, the movable electrode 11, the fixed electrode 21, the arc extinguisher 3 and the like are airtightly surrounded by a tank-like housing 4 within which arc-extinguishing gas is enclosed. A drive mechanism 5 for causing the movable electrode 11 to come in contact with and separate from the fixed electrode 21 is installed outside the housing 4.

The drive mechanism 5 for driving the movable electrode 11 includes, for example, an actuator 51 driven by a spring mechanism, a hydraulic mechanism or the like, a link 52 and an insulating rod 53. The movable electrode 11 is coupled to the link 52 through an operation rod 54 and the rod 53 and is caused by the actuator 51 to move to open/close the contact in the left-right direction indicated by an arrow A in FIG. 2. In the part in which the rod 53 is pulled out of the housing 4, a sliding part 41 having, for example, an O-ring or the like is provided so that the rod 53 can slide while air-tightness is maintained.

The arc extinguisher 3 is supported and insulated from the housing 4 by an insulating support 42. Note that, for the arc-extinguishing gas enclosed within the housing 4, one of sulfur hexafluoride ($SF_6$), carbon dioxide ($CO_2$), trifluoromethane iodide ($CF_3I$), nitrogen ($N_2$), oxygen ($O_2$) methane tetrafluoride ($CF_4$), argon (Ar) and helium (He) or a mixed gas of at least two thereof is used, for example.

Next, the configuration of the arc extinguisher 3 is described with reference to FIG. 2. An arc chamber 31 of the arc extinguisher 3 is formed so as to surround the separated parts of the pair of electrodes 11, 21. This means that the arc chamber 31 is formed so as to surround an arc occurring between the movable electrode 11 and the fixed electrode 21 when current is broken. Furthermore, the arc extinguisher 3 includes: a pressure chamber 32 provided in communication with an opening 21*a* positioned on the fixed electrode 21 side of the arc chamber 31 and maintaining the position relative to the fixed electrode 21 even when the contact is being opened/closed; a thermal puffer unit 33 having a thermal puffer chamber (thermal pressure chamber) 331 placed so as to surround the arc chamber 31 in the circumferential direction of an operation axis 11*c* of the movable electrode 11; and a mechanical puffer unit 34 provided around the movable electrode 11.

The pressure chamber 32 is formed with a bulkhead 321 that is larger than the opening 21*a* with its inner surface facing the opening 21*a*. The bulkhead 321 includes a plurality of outlets 321*a* that provide communication between the pressure chamber 32 and the internal space of the housing 4 outside the arc extinguisher 3. The thermal puffer unit 33 includes: an outer circumference wall 332 of the thermal puffer chamber 331; a guide 334 having a blower opening 333 that provides communication in the radial direction of the arc chamber 31 between the arc chamber 31 and the thermal puffer chamber 331; and a nozzle 335 that retains the guide 334.

The mechanical puffer unit 34 includes: a mechanical puffer cylinder 341 that maintains the position relative to the fixed electrode 21 on the movable electrode 11 side opposite to the fixed electrode 21; a puffer piston 342 that is inserted into the mechanical puffer cylinder 341 and driven in the same direction as the driving direction of the movable electrode 11 to slide over the mechanical puffer cylinder 341; a mechanical puffer chamber (mechanical pressure chamber) 343 comprising a space surrounded by the mechanical puffer cylinder 341 and the puffer piston 342; a plurality of pipes 344 that provide communication between the mechanical puffer cylinder 341 and the thermal puffer chamber 331; and a check valve 345 provided on the mechanical puffer cylinder 341 side of the pipes 344. The check valve 345 is provided to inhibit gas flow from the thermal puffer chamber 331 to the mechanical puffer chamber 343 and allow gas flow in the reverse direction.

As shown in FIG. 2, the center line of the fixed electrode 21 corresponds with the operation axis 11*c* of the movable electrode 11. The fixed electrode 21 comprises a contact tulip including a plurality of elastic contact fingers 21*f*. The contact fingers 21*f* are radially arranged along the side surface of a truncated cone protruding toward the movable electrode 11 side with the operation axis 11*c* as its center axis, and divided into multiple pieces in the circumference direction by a slit (not shown).

The movable electrode 11 is given a potential through the mechanical puffer unit 34 electrically connected to the first conductor 1*a* shown in FIG. 1 and, further, by a conductor 12 that is slidable over the movable electrode 11. The movable electrode 11 and the tulip-shaped fixed electrode 21 form a contact pair. The fixed electrode 21 is electrically connected to the second conductor 2*a* shown in FIG. 1 and has the same potential as that of the second conductor 2*a*. The mechanical puffer unit 34, the thermal puffer unit 33 and the fixed electrode 21 are fixed to a structure supporting the arc extinguisher 3 by a predetermined means (not shown). The movable electrode 11 is driven by the drive mechanism 5 to open/close the contact.

The puffer piston 342 is fastened to the operation rod 54 connected to the movable electrode 11. In the first embodiment, when the operation rod 54 is driven to the contact-opening direction of the movable electrode 11 (leftward in FIG. 2), opening the contact between the movable electrode 11 and the fixed electrode 21 and moving the puffer piston 342 in the direction of pulling it out of the mechanical puffer cylinder 341 are performed at the same time. When the puffer piston 342 is moved in the direction of pulling it out of the mechanical puffer cylinder 341, the volume within the mechanical puffer chamber 343 is reduced and the arc-extinguishing gas in the mechanical puffer chamber 343 is compressed, increasing the pressure. Note that, when the contact is closed between the movable electrode 11 and the fixed electrode 21, the mechanical puffer chamber 343 is in communication with the space within the housing 4 and filled with the arc-extinguishing gas.

The pressure chamber 32 is surrounded by a protective cover 322 and the bulkhead 321, the protective cover 322 being shaped like the side surface of a cone and provided in order to prevent heated gas from flowing into the pressure chamber 32 through the slits between the adjacent contact fingers 21*f*, the pressure chamber 32 being in communication with the arc chamber 31 through the opening 21*a* surrounded by the tip portion of the fixed electrode 21. Also, the pressure chamber 32 is a cone-shaped space provided between the bulkhead 321 and the thermal puffer chamber 331 by utilizing the cone-shaped space formed by a recess on the inner circumference side of the annular thermal puffer chamber 331. Due to this, the inner surface of the bulkhead 321 opposite to the opening 21*a* is larger than the opening 21*a*. This configuration advantageously reduces the size of the arc extinguisher 3 in the longitudinal direction. An outlet 321*a* is provided in the bulkhead 321 to discharge heated gas accumulated in the pressure chamber 32 into the housing 4.

The arc chamber 31 is an arc occurring space defined by the tip portion 21*t* of the contact fingers 21*f* comprising the fixed electrode 21 and the tip portion 11*t* of the movable electrode 11, radially surrounded by the annular thermal puffer chamber 331. The wall surface of the inner circumference side of the thermal puffer chamber 331 includes the nozzle 335 and the guide 334, the thermal puffer chamber 331 having a wedge-shaped cross section. The guide 334, positioned at the vertex of the wedge shape, includes the plurality of blower openings 333 radially provided, providing communication between the arc chamber 31 and the thermal puffer chamber 331. Also, the outer circumference of the thermal puffer chamber 331 includes the cylindrical outer circumference wall 332, the outer diameter of the outer circumference wall 332 defining the largest diameter dimension of the arc extinguisher 3.

In the first embodiment, the gas circuit breaker configured as above includes an ablative material that does not include hydrogen atoms but has a carbon-oxygen bond in a main chain or ring part as an insulating material that is placed so as to generate decomposition gas in response to a direct or indirect action from an arc occurring between the pair of electrodes 11, 21 when current is broken. When the current is broken, the decomposition gas generated from the ablative material is used for arc extinguishing. More specifically, in order to increase the pressure within the thermal puffer chamber 331, the ablative material is used as an insulating material for constructing the guide 334 in the thermal puffer chamber 331.

The thermal puffer chamber 331 is placed so as to be in communication with the arc chamber 31 that surrounds the separated parts of the pair of electrodes 11, 21. When the thermal puffer chamber 331 receives heated gas due to an arc occurring when the current is broken and the decomposition gas generated from the insulating material, the pressure within the thermal puffer chamber 331 temporarily increases. In this example, the guide 334 having the blower opening 333 that provides communication between the thermal puffer chamber 331 and the arc chamber 31 is constructed of the ablative material. However, the whole of the guide 334 is not necessarily required to be constructed of the ablative material. Only part of the guide 334 (e.g., the surface part) may also be covered with the ablative material. Also, the ablative material may be installed at any place from the part providing the communication between the arc chamber 31 and the thermal puffer chamber 331 to the inside of the thermal puffer chamber 331.

As a specific example of the ablative material, at least one type of compound selected from the group consisting of a perfluoroether-based polymer, a fluorine elastomer and a 4-vinyloxy-1-butene (BVE) cyclized polymer may be used.

As a specific example of the perfluoroether-based polymer, compounds given by general formulas (1), (1a), (1b) and general formulas (2), (2a), (2b) below may be listed, for example. As a specific example of the 4-vinyloxy-1-butene (BVE) cyclized polymer, compounds given by general formulas (3)-(5) below may be listed, for example. However, the ablative material used in the invention is not limited to the above.

[Chem. 1]
Chem. 1

(1)

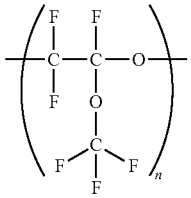

(1a)

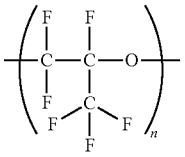

(2)

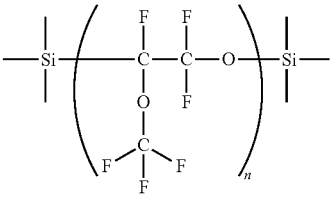

(2a)

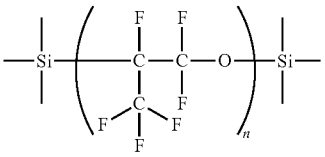

-continued (1b)

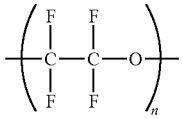

(2b)

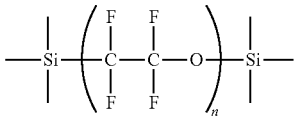

[Chem. 2]
Chem. 2

(3)

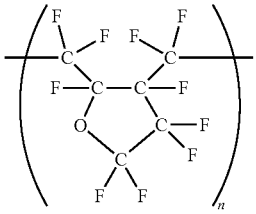

(4)

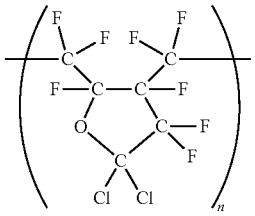

(5)

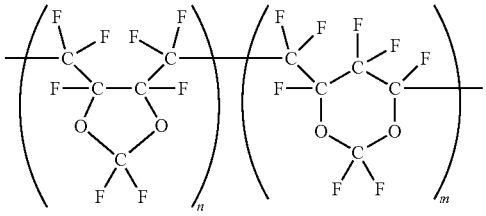

An effect of using the above-described ablative material as an insulating material for constructing the guide 334 is described below. The ablative material has a carbon-oxygen bond in a main chain or ring part. So, heat of an arc breaks the carbon-oxygen bond in a main chain or ring part, causing main part of the composition to be decomposed and gasified. The volume of the gasified gas is significantly increased in comparison with a case in which no carbon-oxygen bond exists and a case in which a carbon-oxygen bond exists only in aside chain. Especially, when an ablative material having a carbon-oxygen bond in a main chain is used, the bond is easier to be broken, which can rapidly increase the amount of gas generated by the decomposition, further facilitating the arc extinguishing.

Also, since the ablative material does not include hydrogen atoms, it does not generate highly oxidative hydrogen fluoride through the reaction with sulfur hexafluoride as arc-extinguishing gas. Note that part of the ablative material is not decomposed but gasified through evaporation or sublimation. Thus, decomposition by heat of the arc is fully performed, which can significantly increase the pressure within the thermal puffer chamber 331. Furthermore, when the ablative material is a fluorine-based resin, it is decomposed by heat of the arc to generate many fluorine ions. The fluorine ions have a high electronegativity and, when the arc is cooled and extinguished, quickly bond with other ions, thereby providing an effect of improving arc extinguishing capability.

Note that, conventionally, for the purpose of increasing the pressure within the thermal puffer chamber 331, for example, an organic compound including hydrogen atoms, such as polyacetal (POM), acrylate resin (PMMA) and polyethylene (PE), has been used as a material that is easily decomposed or evaporated by heat of an arc. When the guide 334 is constructed of the organic compound, hydrogen is generated through decomposition by heat of the arc. For example, when a gas including fluorine, such as $SF_6$ gas, is used as an arc-extinguishing gas, the generated hydrogen combines with the fluorine generated by decomposition of the arc-extinguishing gas to generate hydrogen fluoride. This hydrogen fluoride is extremely corrosive and deteriorates an insulator for supporting the arc extinguisher 3 or the like to reduce dielectric strength.

On the other hand, when a fluorine resin that does not include hydrogen atoms, such as polytetrafluoroethylene (PTFE) and perfluoroalkylvinyl ether copolymer (PFA), is used as an insulating material for constructing the guide 334, hydrogen fluoride is not generated, which can suppress deterioration of the insulator. However, since these materials do not include any carbon-oxygen bond in the composition or do include a carbon-oxygen bond only in a side chain, their decomposition by heat of an arc is not fully performed, and the amount of increase in the pressure within the thermal puffer chamber 331 is smaller than that in the case of using POM or the like. In view of the above, the above-described ablative material is suitable for an insulating material that generates decomposition gas used for arc extinguishing.

Next, an operation of extinguishing an arc occurring when current is broken in the gas circuit breaker configured as above is described. First, a current breaking operation is described. When a contact opening command is given to the gas circuit breaker with the contact closed, the actuator 51 is activated to drive the movable electrode 11 (leftward in FIG. 2), then the contact opens between the fixed electrode 21 and the movable electrode 11, causing an arc to occur in the arc chamber 31. In the case of a relatively large current, such as a short-circuit current, heated gas caused by the arc flows into the thermal puffer chamber 331 through the blower opening 333. This increases the pressure within the thermal puffer chamber 331. Note that, the volume of the thermal puffer chamber 331 does not change. Furthermore, since the above-described ablative material is used for the guide 334, gas generated through decomposition and evaporation of the ablative material due to heat of the arc further increases the pressure within the thermal puffer chamber 331.

Also, in conjunction with the movable electrode 11, the puffer piston 342 slides over the mechanical puffer cylinder 341, compressing arc-extinguishing gas within the mechanical puffer chamber 343 to increase the pressure. Since alternating current repeats maximum value and zero value for each half cycle, in the period during which current decreases from maximum value to zero value, especially in proximity to zero value, current of the arc becomes small, and the amount of heat generated also becomes small. Accordingly, in this time period, the pressure within the thermal puffer chamber 331 becomes higher than that within the arc chamber 31, which causes arc-extinguishing gas to blow onto the arc from the thermal puffer chamber 331 through the blower opening 333. Furthermore, when the pressure within the mechanical puffer chamber 343 becomes higher than that within the thermal puffer chamber 331, the check valve 345 opens and arc-extinguishing gas in the mechanical puffer chamber 343 flows into the thermal puffer chamber 331 through the pipes

344, which enhances the flow of arc-extinguishing gas blown onto the arc from the thermal puffer chamber 331 through the blower opening 333.

In FIG. 2, arc-extinguishing gas blown onto the arc from the thermal puffer chamber 331 through the blower opening 333 is divided into two directions, one direction toward the fixed electrode 21 (rightward) and the other direction toward the movable electrode 11 (leftward), which provides an effect of dividing the arc. Furthermore, gas heated by heat of the arc is efficiently discharged to the outside through two passages provided to the right and left, that is, from the opening on the left side of the nozzle 335 and through the passage from the opening 21*a* through the pressure chamber 32 to the outlet 321*a*.

In this way, arc-extinguishing gas is blown onto the arc to efficiently discharge heat between the electrodes to the outside, thereby extinguishing the arc, and at the same time, the movable electrode 11 and the fixed electrode 21 are further separated from each other to a distance sufficient to withstand restriking voltage occurring between the electrode to obtain insulation recovery between the electrodes, thereby completing the circuit breaking. Especially, when the gas circuit breaker is applied to a high voltage system, since restriking voltage occurring just before completing the circuit breaking is high, the distance between the electrodes required for insulation recovery becomes longer, but efficiently discharging heat between the electrodes to the outside as described above can shorten the required distance, thereby reducing the size of the arc extinguisher 3 in the longitudinal direction.

As described above, in the first embodiment, in the gas circuit breaker configured such that decomposition gas is generated from the insulating material by an arc occurring when current is broken and the decomposition gas is used for extinguishing the arc, the ablative material that does not include hydrogen atoms but has a carbon-oxygen bond in a main chain or ring part is used as the above-described insulating material for the guide 334 of the thermal puffer chamber 331. This can adequately increase the pressure within the thermal puffer chamber 331, providing a superior current-breaking capability of the gas circuit breaker. Furthermore, generation of hydrogen compound, such as hydrogen fluoride and water, that may cause insulation deterioration can be suppressed, which suppresses deterioration of insulating members installed and improves endurance and reliability, thereby lengthening product life.

Furthermore, the operation rod 54 is driven so as to open the contact between the pair of electrodes 11, 21, and at the same time, compress arc-extinguishing gas within the mechanical puffer chamber 343 by movement of the puffer piston 342, so the structure of the drive mechanism 5 can be simplified, thereby reducing the size of the apparatus. Furthermore, the movable electrode 11 and the puffer piston 342 are designed to be driven, which facilitates weight reduction, providing an effect of reducing actuation force of the actuator 51.

Second Embodiment

Figure 3:
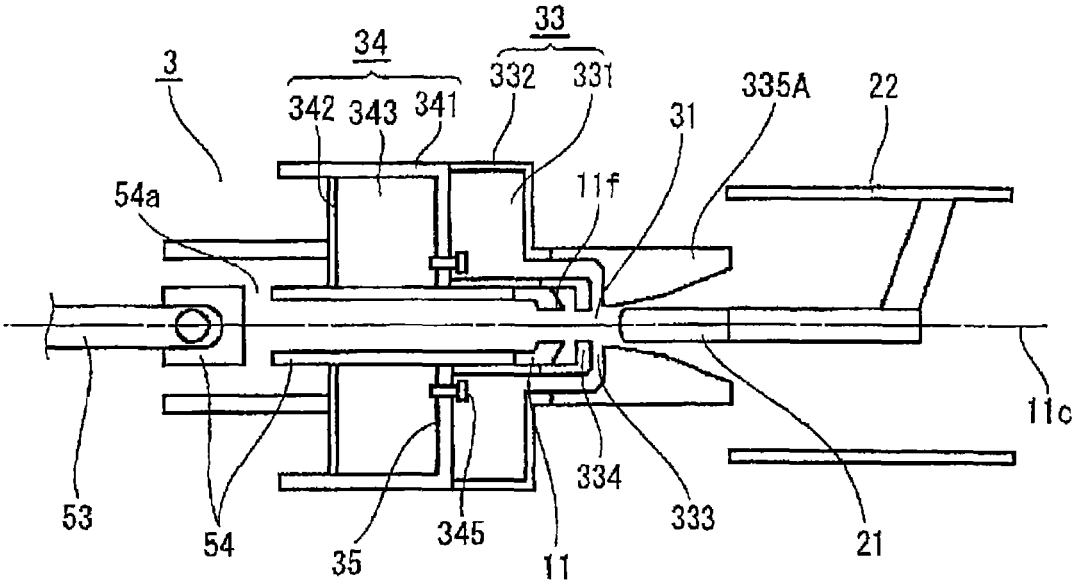
FIG. 3 is a cross-sectional view conceptually showing a main part of an arc extinguisher of a gas circuit breaker in accordance with a second embodiment of the invention.

FIG. 3 is a cross-sectional view showing a main part of an arc extinguisher of a gas circuit breaker in accordance with a second embodiment of the invention, which shows a situation in which an arc (not shown) is occurring between the tip portion of a movable electrode and the tip portion of a fixed electrode that are separated from each other in the course of circuit breaking operation. The general configuration of the gas circuit breaker of the second embodiment is almost similar to that of the first embodiment shown in FIG. 1, so FIG. 1 is also appropriately referenced in the description below. Note that through the drawings, the same or corresponding members or parts are denoted by the same reference numerals.

In the second embodiment, the configuration of a fixed electrode 21 and a movable electrode 11, and the configuration of a thermal puffer unit 33, a mechanical puffer unit 34 and the like are designed to be different from those of the first embodiment. However, an ablative material similar to that used in the first embodiment is used as an insulating material for generating decomposition gas in response to a direct or indirect action from an arc occurring between the pair of electrodes 11, 21 when current is broken, providing an effect similar to that of the first embodiment.

As shown in FIG. 3, an arc extinguisher 3 in the second embodiment includes: an arc chamber 31 in which an arc occurring between the movable electrode 11 and the fixed electrode 21 is formed; an operation rod 54 provided in communication with the movable electrode 11 side of the arc chamber 31 and maintaining the position relative to the movable electrode 11 even when the contact is being opened/closed; a mechanical puffer cylinder 341 placed coaxially with the operation rod 54 so as to surround the operation rod 54 and fixed to the operation rod 54; a puffer piston 342 that is inserted into the mechanical puffer cylinder 341 and slides over the mechanical puffer cylinder 341 when the contact is being opened/closed; and a mechanical puffer chamber 343 comprising a space between the mechanical puffer cylinder 341 and the puffer piston 342.

Furthermore, the arc extinguisher 3 includes: provided closer to the arc chamber 31 than the mechanical puffer chamber 343, a thermal puffer chamber 331 having a cylindrical shape coaxial with the operation rod 54; a bulkhead 35 located between the mechanical puffer chamber 343 and the thermal puffer chamber 331; a check valve 345 provided in the bulkhead 35; a nozzle 335A forming a passage for guiding arc-extinguishing gas from the thermal puffer chamber 331 to the arc chamber 31; and a guide 334 placed so as to surround the movable electrode 11 for guiding arc-extinguishing gas to the arc chamber 31 in conjunction with the nozzle 335A.

Furthermore, at an end of the operation rod 54 opposite to the movable electrode 11, an opening 54*a* is provided in the side of the operation rod 54, and a hydrogen adsorbent (not shown) is placed so as to surround the opening 54*a*. When a small amount of hydrogen exists or is generated in the system, the hydrogen adsorbent adsorbs hydrogen to prevent generation of a material having a negative influence, such as hydrogen fluoride, water and the like. As the hydrogen adsorbent, well known hydrogen occlusion alloy, carbon nanotube, activated carbon and the like may be used, for example. Furthermore, a cooling cylinder 22 is placed around and coaxial with the fixed electrode 21.

The movable electrode 11 is, for example, a contact tulip including a plurality of elastic contact fingers 11*f*. The contact fingers 11*f* are annularly arranged with an operation axis 11*c* as center axis, and divided by a slit (not shown). The movable electrode 11 is given a potential through the mechanical puffer cylinder 341 electrically and slidably connected to a first conductor 1*a* (FIG. 1). The movable electrode 11 and the fixed electrode 21 form a contact pair. The fixed electrode 21 is electrically connected to a second conductor 2*a* (FIG. 1) and has the same potential as that of the second conductor 2*a*.

The mechanical puffer unit 34, the thermal puffer unit 33 and the movable electrode 11 are fixed to the cylindrical operation rod 54 and are driven by a drive mechanism 5 (FIG. 1) through the operation rod 54 to open/close the contact. A puffer piston 342 is inserted into the cylindrical mechanical puffer cylinder 341 with the operation rod 54 as center axis. A mechanical puffer chamber 343 is a space surrounded by the mechanical puffer cylinder 341 and the puffer piston 342. The puffer piston 342 is fixed to a structure supporting the arc extinguisher 3. When the movable electrode 11 is driven toward the contact opening direction, arc-extinguishing gas within the mechanical puffer chamber 343 is compressed to increase the pressure.

The thermal puffer chamber 331 is placed adjacent to the mechanical puffer chamber 343 with the bulkhead 35 in between on the fixed electrode 21 side. The thermal puffer chamber 331 is a space surrounded by a cylindrical outer circumference wall 332 with the operation rod 54 as center axis. The bulkhead 35 located between the mechanical puffer chamber 343 and the thermal puffer chamber 331 includes a plurality of communication openings, each communication opening including the check valve 345 for preventing arc-extinguishing gas from flowing from the thermal puffer chamber 331 into the mechanical puffer chamber 343.

The nozzle 335A for blowing pressure gas including arc-extinguishing gas into the arc chamber 31 is provided in the direction from the thermal puffer chamber 331 to the fixed electrode 21. Arc-extinguishing gas is guided from the thermal puffer chamber 331 to the arc chamber 31 through a space between the nozzle 335A and the guide 334 that is placed so as to surround the movable electrode 11.

Furthermore, in FIG. 3, an ablative material similar to that used in the first embodiment, that is, an insulating material that does not include hydrogen atoms but has a carbon-oxygen bond in a main chain or ring part is used for the nozzle 335A and guide 334 provided at a position near the arc chamber 31 in the part providing communication between the arc chamber 31 and the thermal puffer chamber 331. Note that one or both of the nozzle 335A and the guide 334 may be constructed of the ablative material. Alternatively, at least part of the nozzle 335A or the guide 334 (for example, only the surface part) may be constructed of the ablative material.

In the gas circuit breaker configured as above, when a contact opening command is given by a controller (not shown) and the actuator 51 (FIG. 1) is driven, the movable electrode 11, the mechanical puffer cylinder 341, the outer circumference wall 332, the nozzle 335A and the guide 334 are integrally moved leftward in FIG. 3 through a link 52, a rod 53 and the operation rod 54. This opens the contact between the fixed electrode 21 and the movable electrode 11, causing an arc to occur in the arc chamber 31, while reducing the volume of the mechanical puffer chamber 343 to increase the pressure of arc-extinguishing gas within the mechanical puffer chamber 343. Gas caused by heat of the arc flows into the thermal puffer chamber 331 through the blower opening 333 to increase the pressure within the thermal puffer chamber 331. Note that, the volume of the thermal puffer chamber 331 does not change.

Furthermore, since the above-described ablative material is used for the nozzle 335A and the guide 334, gas generated through decomposition and evaporation of the ablative material due to heat of the arc further increases the pressure within the thermal puffer chamber 331. Note that, in the course of contact opening operation, even when the pressure of arc-extinguishing gas within the mechanical puffer chamber 343 temporarily becomes lower than the pressure within the thermal puffer chamber 331, the check valve 345 prevents heated gas from flowing from the thermal puffer chamber 331 into the mechanical puffer chamber 343, so the pressure within the mechanical puffer chamber 343 increases as the operation rod 54 moves.

In the time period during which reduction in arc current near the zero point of alternating current decreases the amount of heat generated, when the pressure within the thermal puffer chamber 331 becomes higher than that in the arc chamber 31, arc-extinguishing gas is blown onto the arc from the thermal puffer chamber 331 through the blower opening 333. Furthermore, when the pressure within the mechanical puffer chamber 343 becomes higher than that in the thermal puffer chamber 331, the check valve 345 opens and arc-extinguishing gas within the mechanical puffer chamber 343 flows into the thermal puffer chamber 331, so the flow of arc-extinguishing gas blown onto the arc from the thermal puffer chamber 331 through the blower opening 333 is enhanced, causing the arc to be easily extinguished through the process almost similar to that of the first embodiment.

As described above, also in the gas circuit breaker configured as shown in FIG. 3, an effect similar to that of the first embodiment can be obtained, that is, the pressure within the thermal puffer chamber 331 can be increased to an adequately high level, which can provide an enhanced circuit breaking capability. Furthermore, generation of hydrogen fluoride and water that may cause insulation deterioration can be suppressed, which suppresses deterioration of insulating members installed and improves endurance and reliability, thereby lengthening product life.

Figure 4:
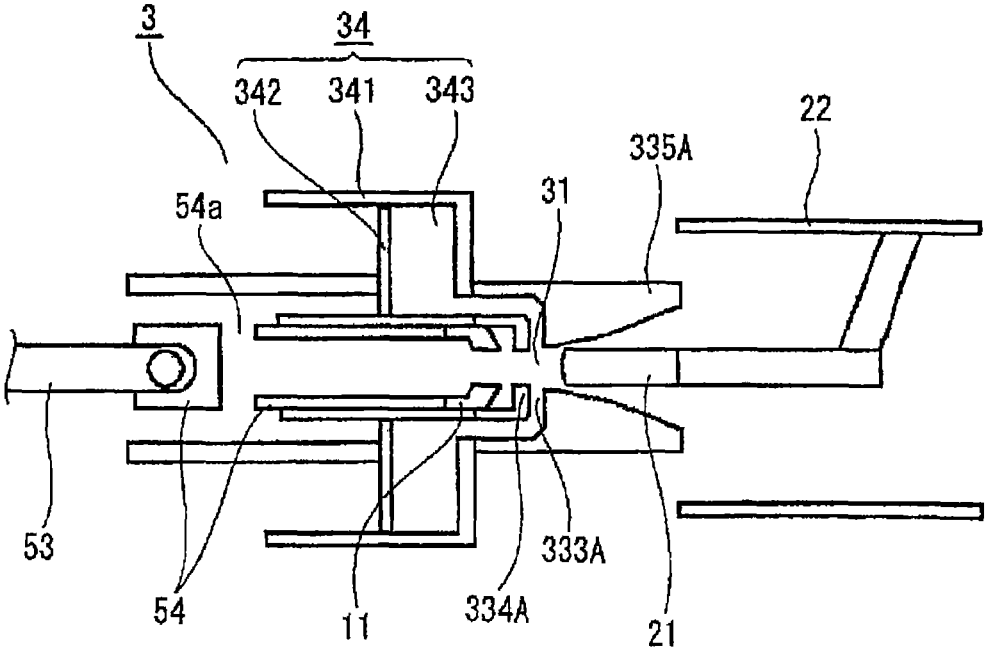
FIG. 4 is a main part cross-sectional view conceptually showing a variation of the arc extinguisher of the gas circuit breaker in accordance with the second embodiment of the invention.
Figure 5A:
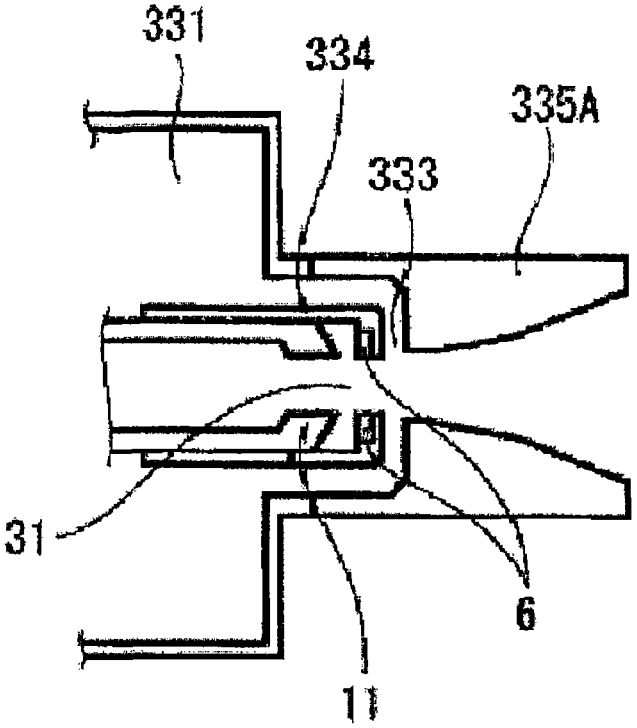
FIG. 5 is a main part cross-sectional view conceptually showing another variation of the arc extinguisher of the gas circuit breaker in accordance with the second embodiment of the invention.
Figure 5B:
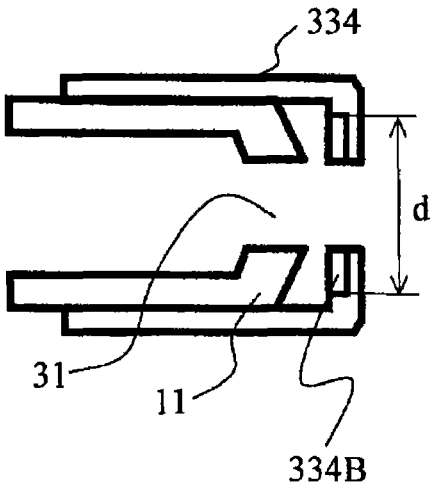
Figure 5C:
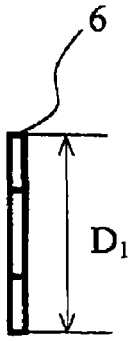
Figure 5D:
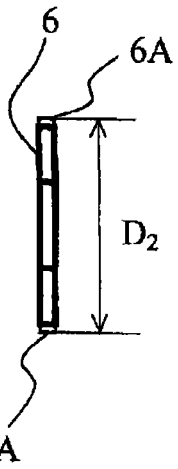
Figure 6:
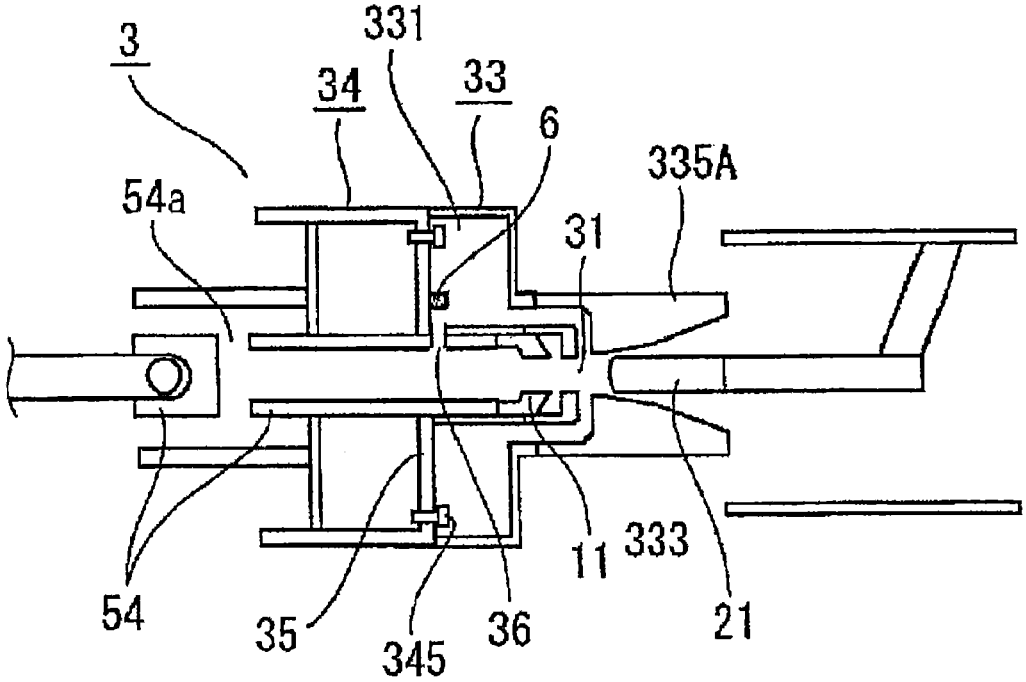
FIG. 6 is a main part cross-sectional view conceptually showing still another variation of the arc extinguisher of the gas circuit breaker in accordance with the second embodiment of the invention.

Note that the case of including the thermal puffer unit 33 has been described with reference to FIG. 3, but the invention is not limited to this, and, for example, variations may be configured as shown in FIGS. 4 to 6, which are described below one by one.

In a variation shown in FIG. 4, the thermal puffer unit 33 shown in FIG. 3 is not included, and the mechanical puffer chamber 343 is in communication with the arc chamber 31 through a blower opening 333A formed of the nozzle 335A and a guide 334A. In this configuration, an effect similar to that of the example of FIG. 3 can be obtained by, for example, constructing the guide 334A of the ablative material. Note that in such a configuration, installation location of the ablative material is not limited to the guide 334A, but the ablative material may be installed at any place subject to a direct or indirect action from an arc. For example, the surface of the nozzle 335A may be covered with the ablative material.

On the other hand, in a further variation shown in FIG. 5 and a still further variation shown in FIG. 6, the thermal puffer unit 33 similar to that of the example of FIG. 3 is included, but the ablative material 6 is installed in a place different from the place from the part providing communication between the arc chamber 31 and the thermal puffer chamber 331 to the inside of the thermal puffer chamber 331, in which the ablative material 6 is exposed to an arc or heated gas due to the arc.

The example shown in FIG. 5 is described. In this example, as shown in FIG. 5A, an ablative material 6 is installed on the guide 334 opposite to the blower opening 333 and facing the movable electrode 11 and the arc chamber 31. In this configuration, an effect similar to the example of FIG. 3 can be obtained, and further, even when the ablative material 6 is a rubber-like elastic material, such as fluorine elastomer that is a resin material given by the general formulas (1)-(5), a similar effect can be obtained. Furthermore, an effect of increasing puffer pressure can be obtained without affecting the shape of the blower opening 333 that affects the circuit breaking capability, such as flow rate and angle of the blowing.

FIG. 5B shows the guide 334 before the attachment of the ablative material 6 in the gas circuit breaker shown in FIG. 5A. At a position in the guide 334 facing the movable electrode 11 and the arc chamber 31, an ablative material attachment area 334B (inner diameter: d) onto which the annular ablative material 6 is to be attached is provided. FIGS. 5C and 5D show the ablative material 6 to be attached to the guide 334. These will be fit into the ablative material attachment area 334B. FIG. 5C shows the annular ablative material 6 with an outer diameter of $D_1$. FIG. 5D shows the annular ablative material 6 with an outer diameter of $D_2$, including a plurality of attachment protrusions 6A provided on the outer edge.

As shown, when the outer edge of the ablative material 6 has a circular or almost circular shape and is constructed of a rubber-like elastic material, the outer diameter ($D_1$, $D_2$) is dimensioned so that $D_1$ (or $D_2$)>d, where d is the inner diameter of the ablative material attachment area 334B. The ablative material 6 that satisfies this condition is compressed and attached into the ablative material attachment area 334B and then fixed by its elasticity. This simplifies the attachment mechanism and also facilitates fabrication.

On the other hand, in the variation shown in FIG. 6, a block-like ablative material 6 is provided on the bulkhead 35 forming the thermal puffer chamber 331 near a reflux passage 36 from the operation rod 54 to the thermal puffer chamber 331. In this configuration, heated gas due to an arc occurring in the arc chamber 31 when current is broken flows through the reflux passage 36 into the thermal puffer chamber 331, thereby decomposing by heat the ablative material 6 to increase the pressure within the thermal puffer chamber 331. This provides an effect similar to that of the example of FIG. 3, which can prevent insulation deterioration of the insulating structure due to hydrogen fluoride.

Third Embodiment

In the third embodiment, in the ablative material 6 given by the general formulas (1)-(5) described in the first embodiment, sulfur (S) is included in part of the composition, for example, part of a main chain or part of a side chain. Alternatively, when the ablative material 6 given by the general formulas (1)-(5) is molded, sulfur or a compound including sulfur is added. The schematic configuration of the gas circuit breaker in accordance with the third embodiment is almost similar to that of the first embodiment shown in FIG. 1, and the installation location of the ablative material 6 is also similar to that of the first and second embodiments, so the description is omitted here.

Figure 7:
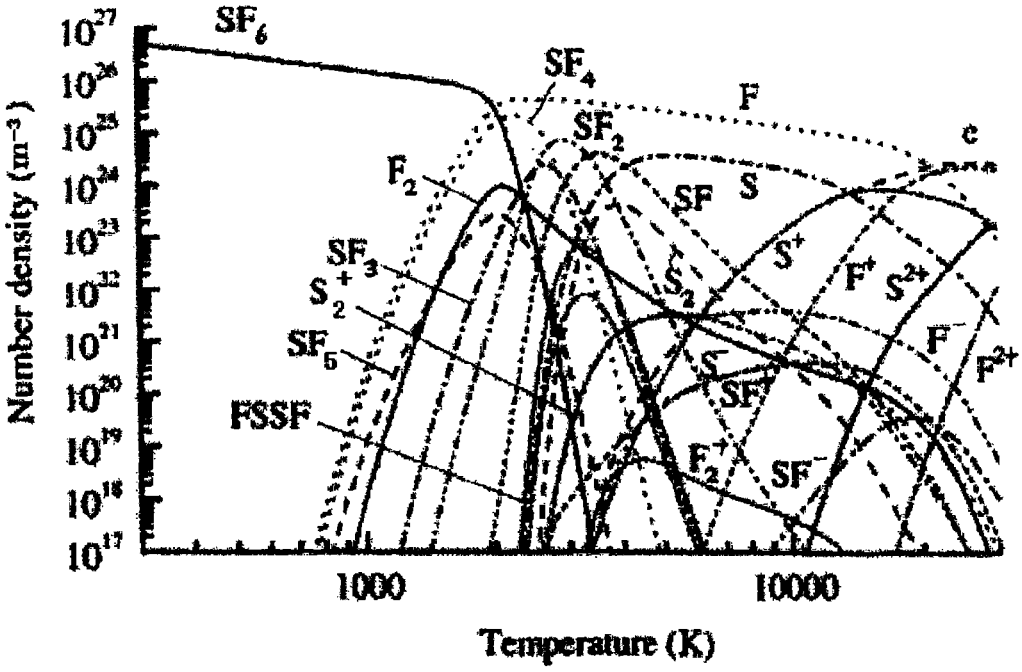
FIG. 7 is a chart showing the temperature dependence of the density of particles generated through decomposition of sulfur hexafluoride gas used as arc-extinguishing gas.

FIG. 7 shows the temperature dependence of the density of particles generated through decomposition of sulfur hexafluoride ($SF_6$) gas used as arc-extinguishing gas. In FIG. 7, the vertical axis indicates the particle density ($m^{-3}$), and the horizontal axis indicates the temperature (K). With the ablative material 6 in accordance with the third embodiment including fluorine, when the ablative material 6 is evaporated and decomposed by heat of an arc, fluorine and sulfur are generated, which are combined into compounds, such as $SF_3$, $SF_4$ and $SF_5$, in the course of cooling the arc. These compounds are, as shown in FIG. 7, the same as compounds having a high level of arc-extinguishing capability, generated through decomposition of sulfur hexafluoride as an arc-extinguishing gas.

According to the third embodiment, an ablative material 6 similar to that used in the first embodiment with part of the composition including sulfur or with sulfur or a compound including sulfur added thereto is used to provide an effect similar to that of the first embodiment and an additional effect of improving arc-extinguishing capability. Especially, when gas, such as carbon dioxide and air, not including fluorine nor sulfur is used as an arc-extinguishing gas, the ablative material 6 in accordance with the third embodiment provides its effect. Note that according to the invention, part or all of the embodiments may be freely combined and the embodiments may be appropriately modified or omitted within the scope of the invention.

The invention claimed is:

1. A gas circuit breaker comprising: a pair of electrodes provided so as to be able to come in contact with and separate from each other; and an insulating material that is placed so as to generate a decomposition gas in response to a direct or indirect action from an arc occurring between the pair of electrodes when a current is broken, wherein the decomposition gas generated from the insulating material when the current is broken is configured to be utilized for extinguishing the arc, and wherein an ablative material that does not include hydrogen atoms but has a carbon-oxygen bond in a main chain or ring part is used as the insulating material.

2. The gas circuit breaker according to claim 1, wherein at least one type of compound selected from the group consisting of a perfluoroether-based polymer and a 4-vinyloxy-1-butene (BVE) cyclized polymer is used as the ablative material.

3. The gas circuit breaker according to claim 1, wherein the ablative material has as part of its composition sulfur.

4. The gas circuit breaker according to claim 1, wherein the ablative material has sulfur or a compound including sulfur added thereto.

5. The gas circuit breaker according to claim 1, further comprising: an arc chamber formed so as to surround the separated parts of the pair of electrodes; and a puffer chamber placed so as to be in communication with the arc chamber, wherein, when the puffer chamber receives a heated gas due to the arc occurring when the current is broken and the decomposition gas, the pressure within the puffer chamber temporarily increases.

6. The gas circuit breaker according to claim 5, wherein the ablative material is installed at any place from the part providing the communication between the arc chamber and the puffer chamber to the inside of the puffer chamber.

7. The gas circuit breaker according to claim 6, further comprising a nozzle member or guide member for blowing a pressure gas including an arc-extinguishing gas into the arc chamber, at a position near the arc chamber in the part providing the communication between the arc chamber and the puffer chamber, wherein at least part of the nozzle member or the guide member is constructed of the ablative material.

8. The gas circuit breaker according to claim 5, wherein the ablative material is installed in a place different from the place from the part providing the communication between the arc chamber and the puffer chamber to the inside of the puffer chamber, in which the ablative material is exposed to the arc or heated gas due to the arc.

* * * * *